US007063576B2

(12) United States Patent
Ooi et al.

(10) Patent No.: US 7,063,576 B2
(45) Date of Patent: Jun. 20, 2006

(54) L-SHAPED BULB SOCKET

(75) Inventors: Masashi Ooi, Yokkaichi (JP); Masaki Okamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/991,567

(22) Filed: Nov. 18, 2004

(65) Prior Publication Data

US 2005/0112925 A1 May 26, 2005

(30) Foreign Application Priority Data

Nov. 21, 2003 (JP) ..... 2003-392469

(51) Int. Cl.
*H01R 24/00* (2006.01)
*H01R 13/53* (2006.01)

(52) U.S. Cl. ..... 439/699.2; 439/182

(58) Field of Classification Search ..... 439/182, 439/736, 699.2, 619, 605, 699.1, 854, 855; 362/226
See application file for complete search history.

(56) References Cited

U.S. PATENT DOCUMENTS

| | | | | |
|---|---|---|---|---|
| 5,087,213 | A * | 2/1992 | Drapcho et al. | 439/672 |
| 5,637,020 | A * | 6/1997 | Ito | 439/699.2 |
| 5,711,674 | A * | 1/1998 | Chu | 439/11 |
| 5,846,100 | A * | 12/1998 | Ogawa | 439/736 |
| 5,876,251 | A * | 3/1999 | Muta | 439/699.2 |
| 6,257,736 | B1 * | 7/2001 | Fehrenbach | 362/640 |
| 2003/0068929 | A1 * | 4/2003 | Powers et al. | 439/699.2 |

FOREIGN PATENT DOCUMENTS

JP 2003-217768 7/2003

* cited by examiner

*Primary Examiner*—Chandrika Prasad
(74) *Attorney, Agent, or Firm*—Gerald E. Hespos; Anthony J. Casella

(57) ABSTRACT

Each terminal (3) of a bulb socket (1) has a power-supplying tab (31) and a bulb connecting portion (32) that are integral with one another. The bulb connecting portion (32) is on an extension of the power-supplying tab (31) extending along an inserting direction into a connector accommodating portion (25). Thus, the bulb socket (1) is reduced in height, the number of assembling steps is reduced, and the deformation of the terminals can be avoided. Further, a reduction in the number of parts leads to reduced production costs.

5 Claims, 9 Drawing Sheets

L-SHAPED BULB SOCKET

BACKGROUND OF THE INVENTION

1. Field of the Invention

The present invention relates to a bulb socket.

2. Description of the Related Art

Japanese Unexamined Patent Publication No. 2003-217768 discloses an L-shaped bulb socket. The L-shaped bulb socket has first and second openings. The first opening is a connector accommodating portion for accommodating a power-supply side connector and the second opening is a bulb accommodating portion for accommodating a bulb. The first and second openings extend in directions substantially normal to each other. Separate bulb terminals and connector terminals are accommodated in the L-shaped bulb socket for connection respectively with the bulb and the connector. The separate bulb terminals and connector terminals are assembled in a socket main body, and ends of these terminals are connected together at a coupling to define an L-shape. With this design, a bulb connecting portion is higher by as much as the coupling and the socket has been bulky.

Further, the separate bulb terminals and connector terminals require an increased number of assembling steps, a danger of deforming the terminals due to wrenching as the terminals are assembled, and an increased number of parts, which leads to a poor yield and a higher production cost.

The present invention was developed in view of the above problems and one object thereof is to provide a smaller or shorter bulb socket.

SUMMARY OF THE INVENTION

The invention is directed to a bulb socket with a socket main body. The socket main body has openings that define a bulb accommodating portion and a connector accommodating portion. The bulb accommodating portion is dimensioned to receive a bulb and the connector accommodating portion is dimensioned to receive a power-supply. The two openings are substantially normal to each other. The bulb socket also has a terminal to be inserted into the socket main body. The terminal comprises a power-supplying tab that extends in an inserting direction into the connector accommodating portion for connection with the power-supply side connector. The terminal also has a bulb connecting portion for connection with the bulb. The bulb connecting portion is on an extension of the power-supplying tab so that the power-supplying tab and the bulb connecting portion overlap with respect to the height direction. The bulb connecting portion does not project up normal to the extension of the power-supplying tab. Thus, the height of the bulb socket can be reduced.

The power-supplying tab and the bulb connecting portion preferably are integral with one another. Thus, it is unnecessary to provide couplings for coupling the terminals, and the bulb socket can be smaller. Further, it is unnecessary to assemble both terminals. Thus, the number of assembling steps is reduced and the deformation of the terminals due to wrenching during assembly is avoided. Further, fewer parts leads to lower production cost.

The connector accommodating portion preferably has an introducing channel so that the bulb connecting portion can be introduced from the connector accommodating portion to the bulb accommodating portion. With this construction, a separate opening for mounting the terminal is unnecessary and the bulb socket can be watertight.

A retainer preferably is accommodated in the introducing channel and is assembled with the power-supplying tab to retain the terminal. Thus, the power-supplying tab will not shake in the introducing channel during insertion of the terminal into the bulb socket, and the terminal can be inserted smoothly.

DETAILED DESCRIPTION OF THE PREFERRED EMBODIMENTS

Figure 1:
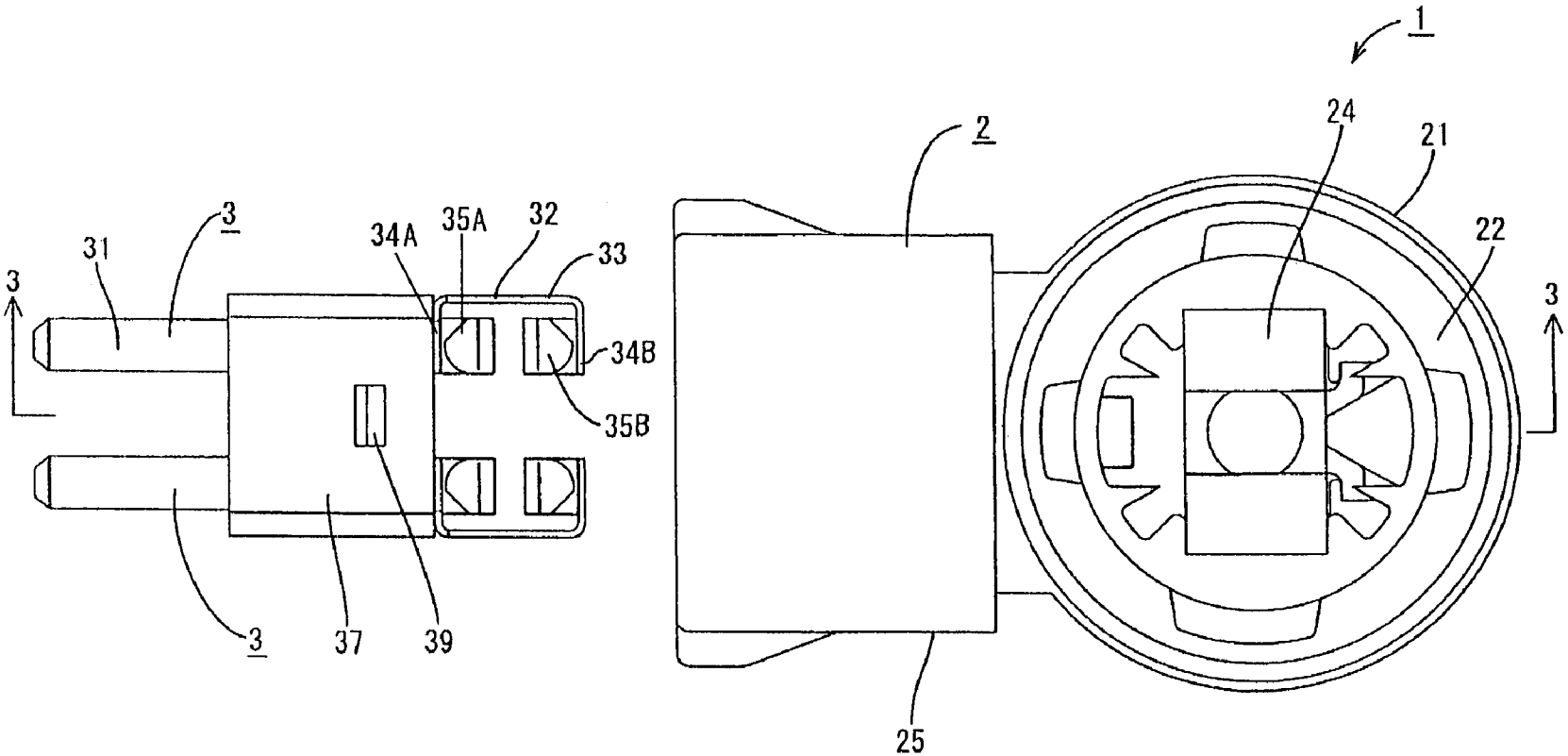
FIG. 1 is a plan view showing a socket main body of a bulb socket and terminals assembled with a retainer according to the invention.
Figure 2:
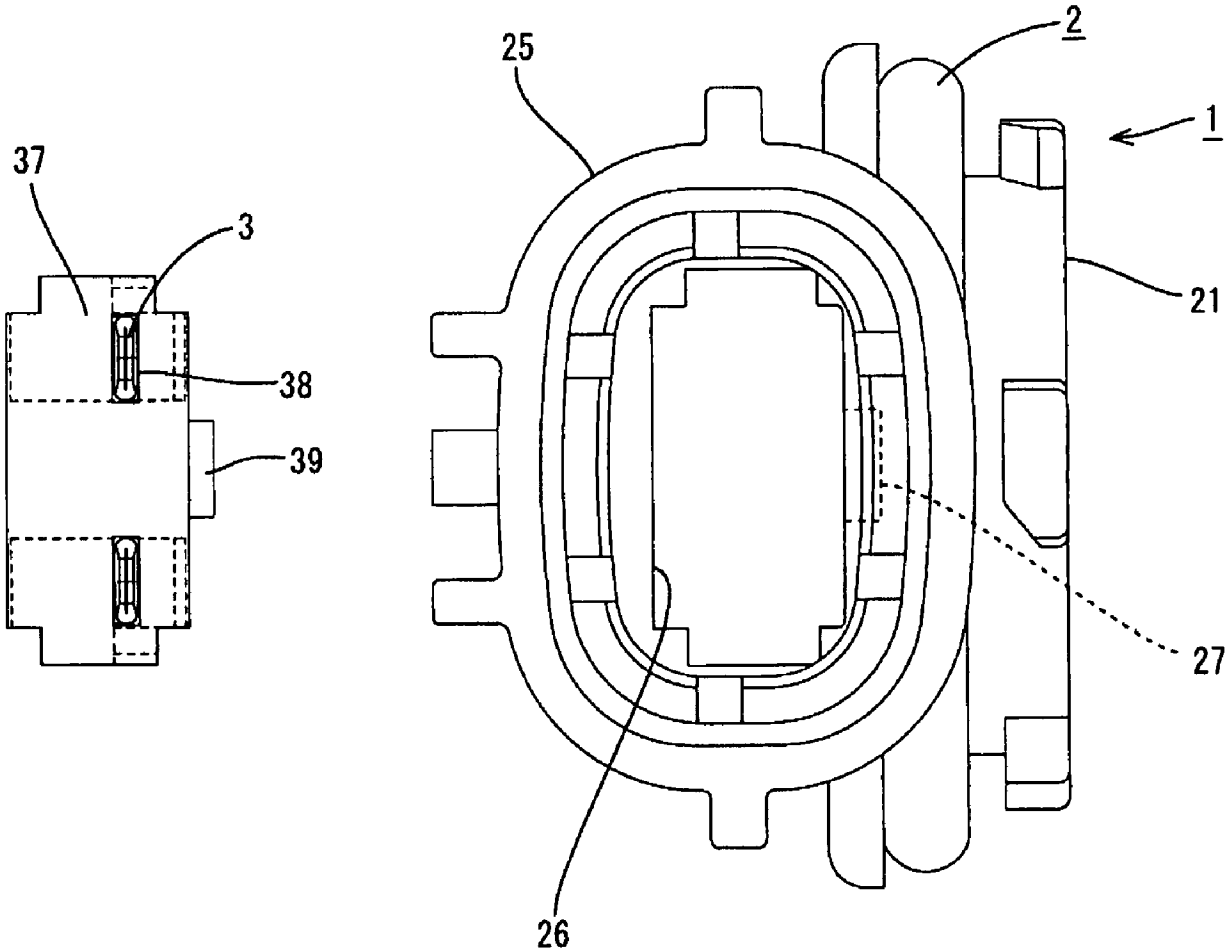
FIG. 2 is a side view showing the socket main body and the terminals assembled with the retainer.
Figure 3:
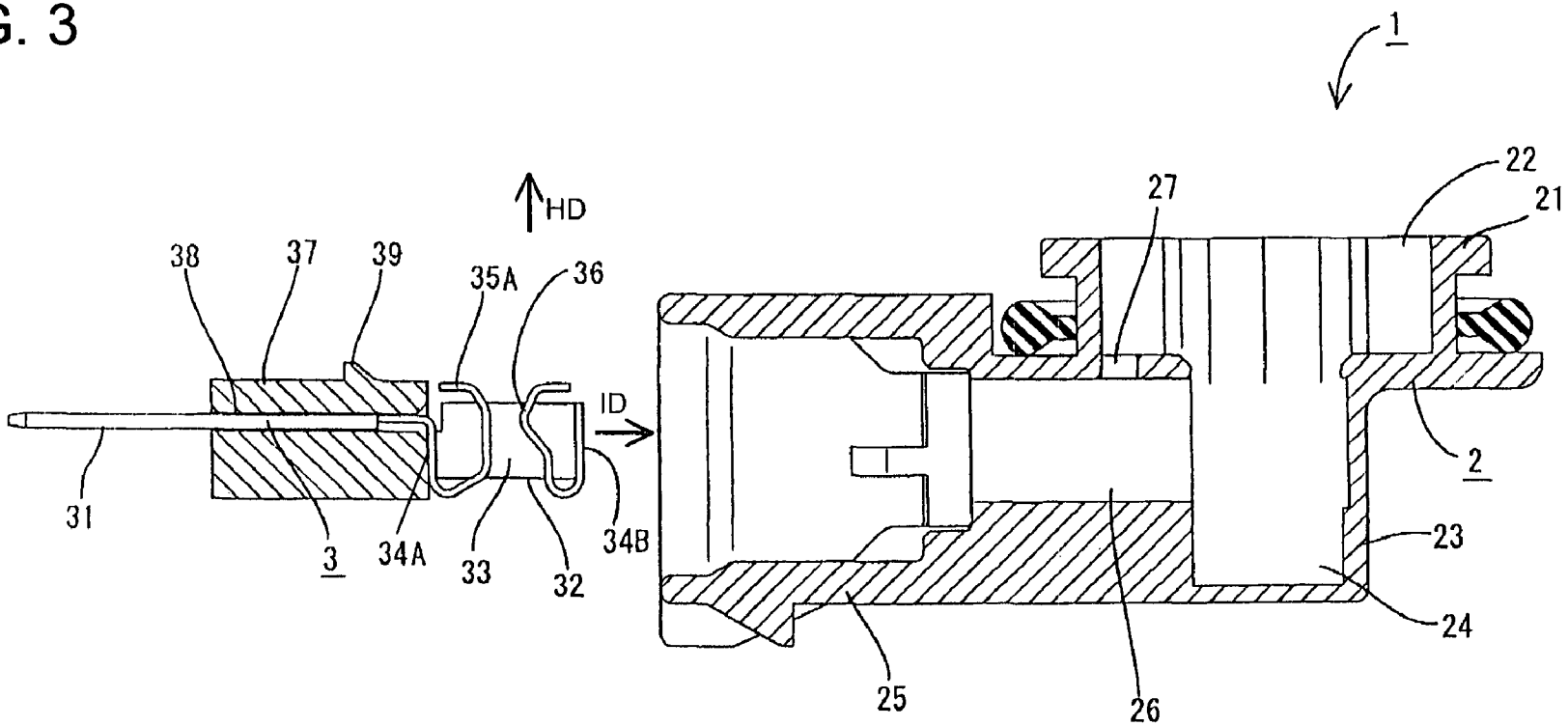
FIG. 3 is a section along 3—3 of FIG. 1.
Figure 4:
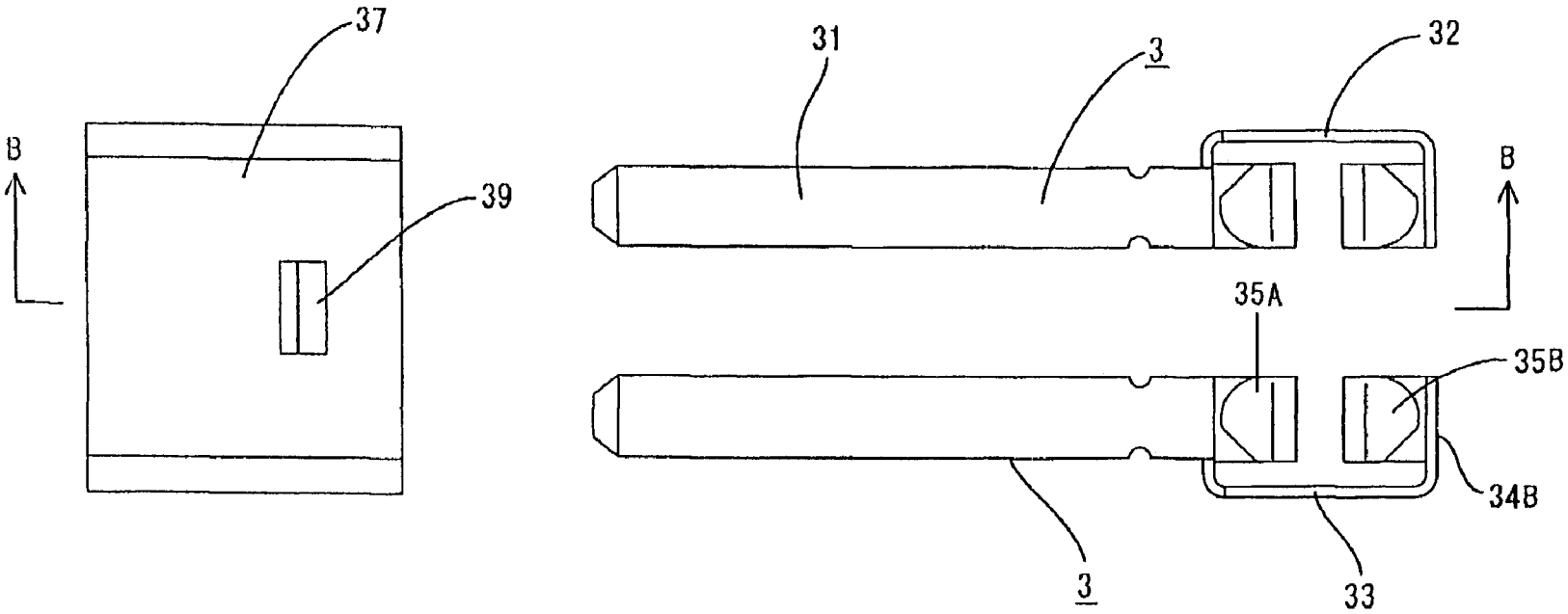
FIG. 4 is a plan view of the terminals and the retainer.
Figure 5:
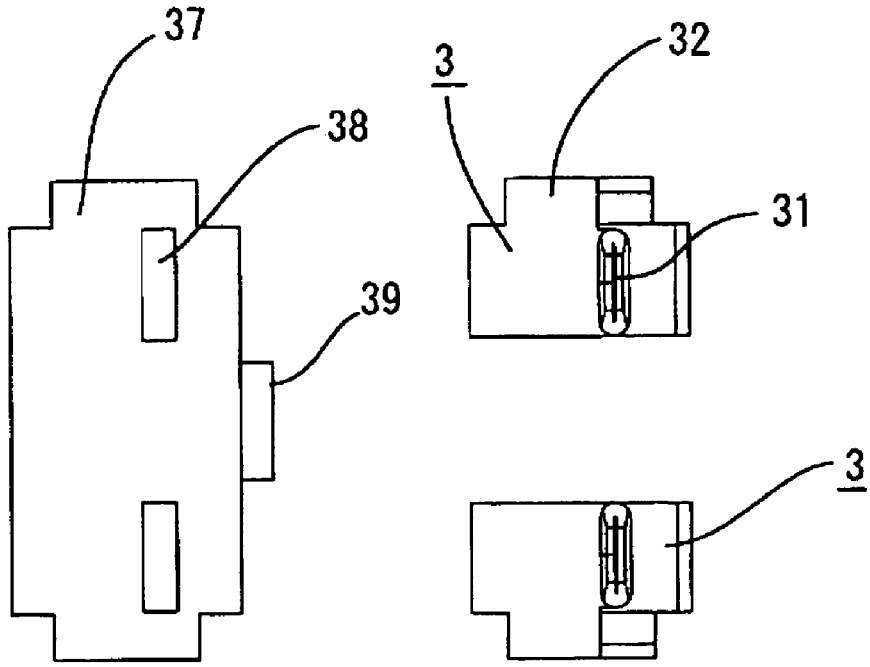
FIG. 5 is a side view of the terminals and the retainer.
Figure 6:
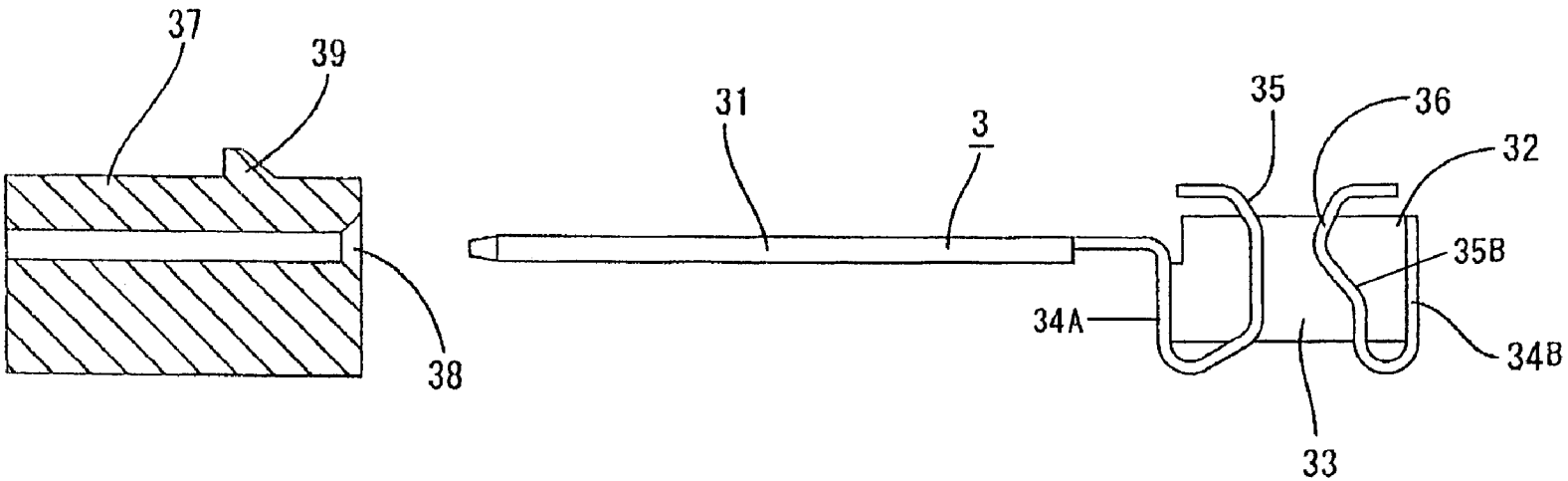
FIG. 6 is a section along 6—6 of FIG. 4.
Figure 7:
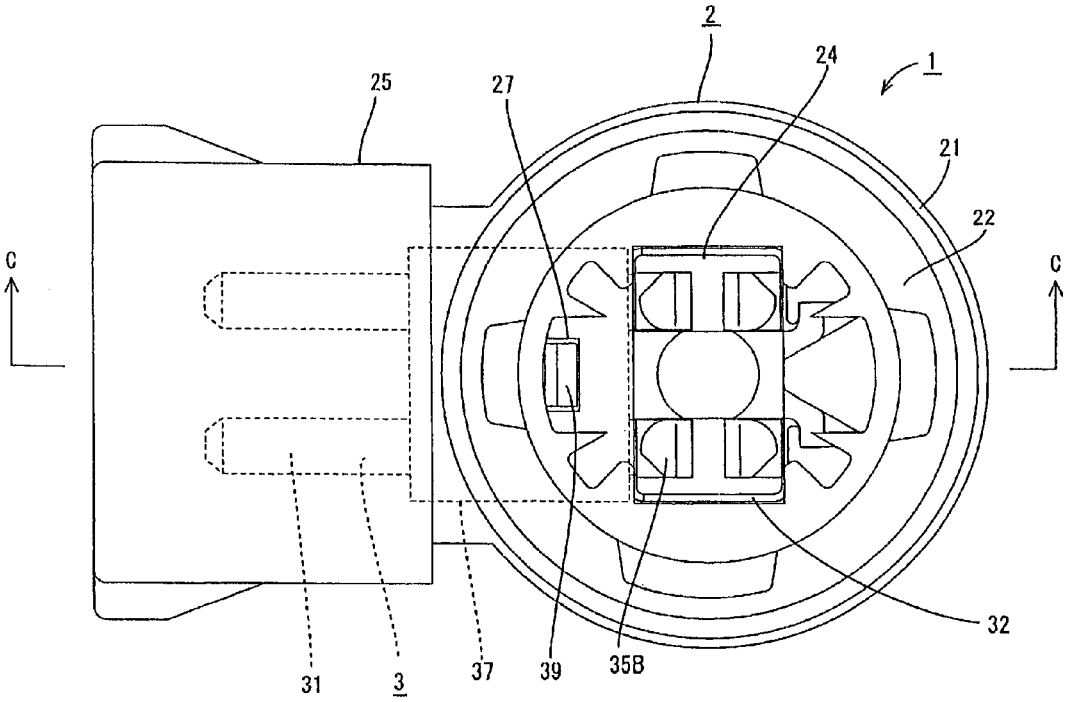
FIG. 7 is a plan view of the bulb socket assembled with the terminals.
Figure 8:
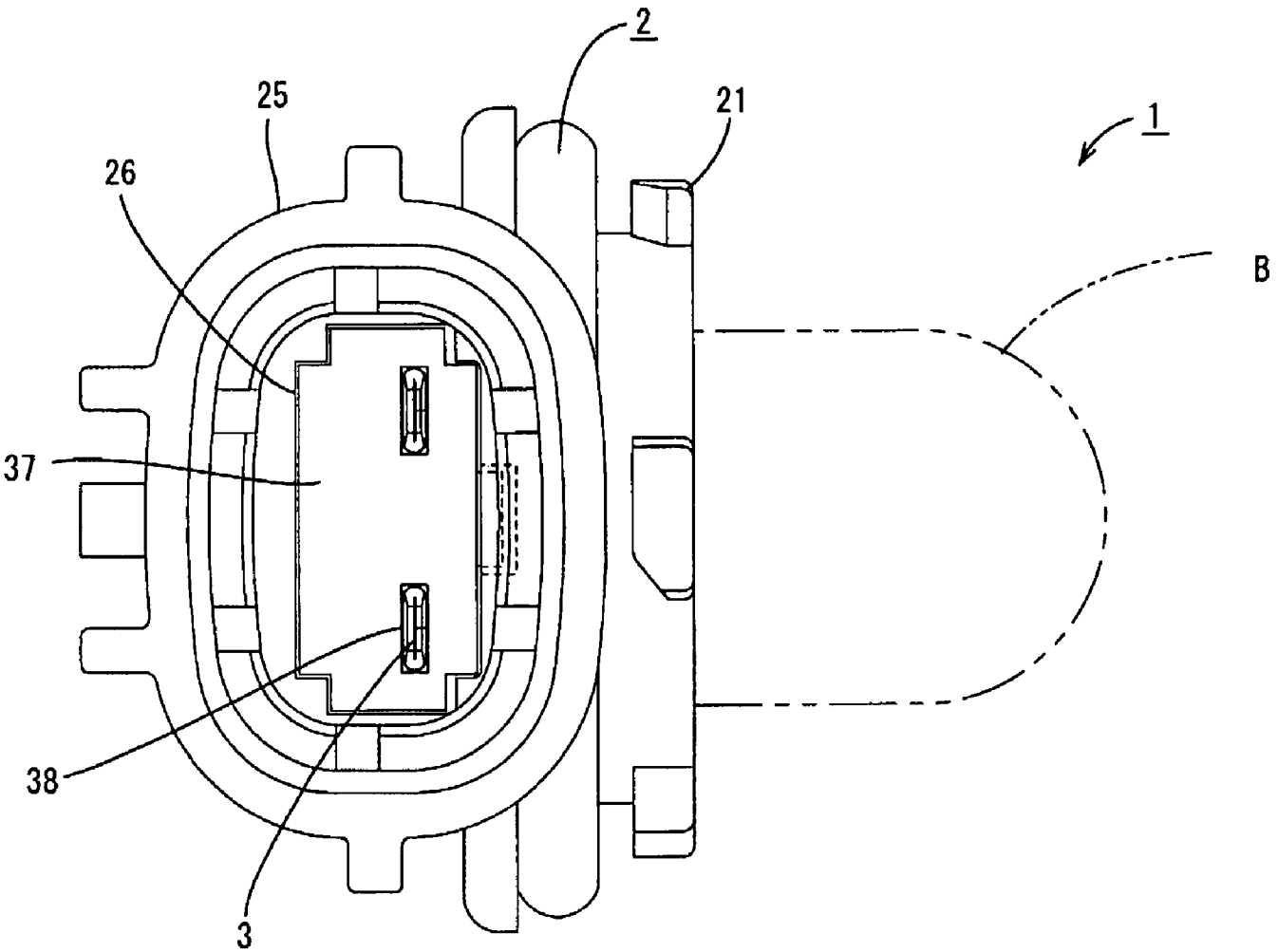
FIG. 8 is a side view of the bulb socket assembled with the terminals.
Figure 9:
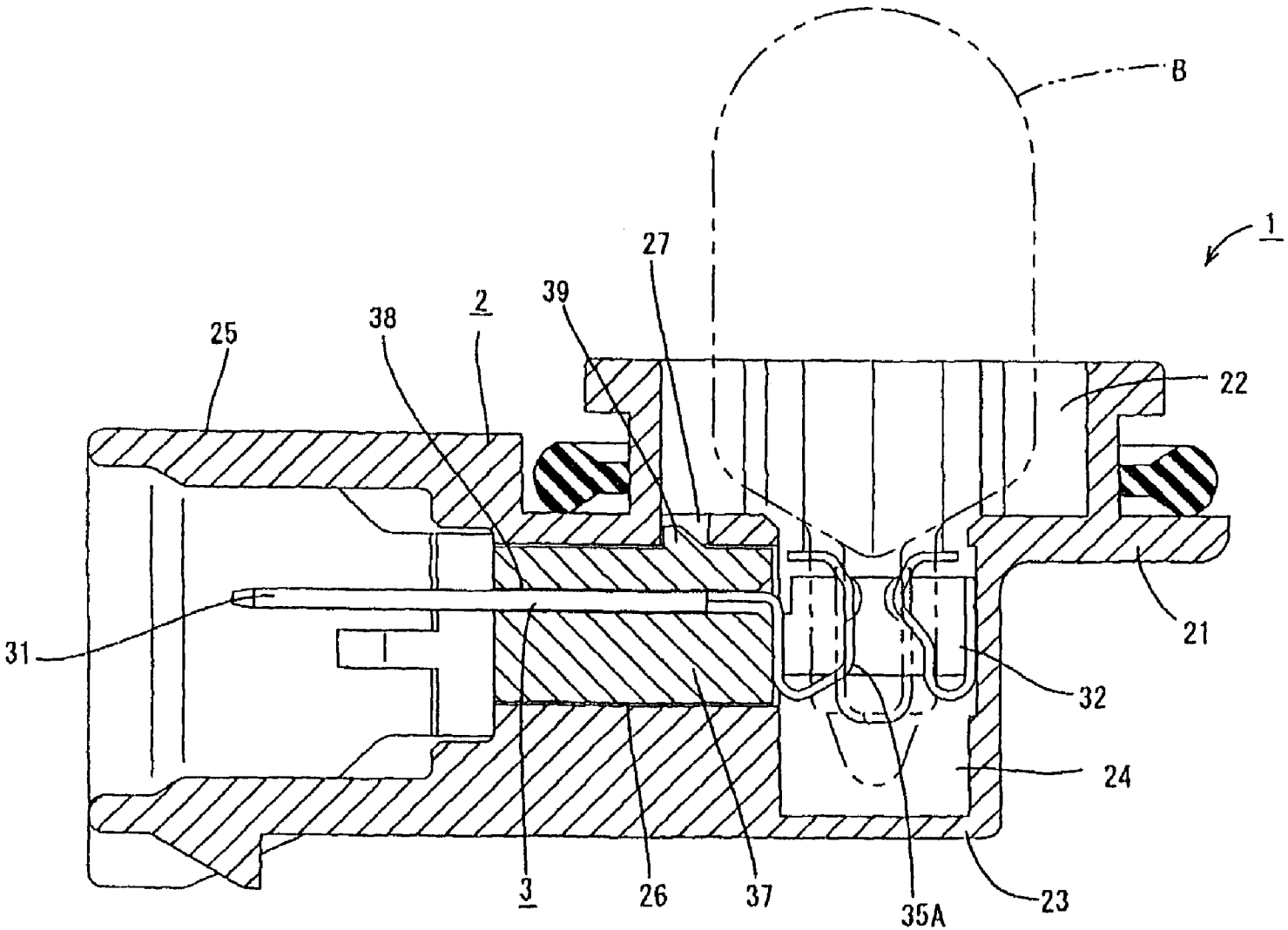
FIG. 9 is a section along 9—9 of FIG. 7.

A bulb socket according to one embodiment of the invention is identified by the numeral 1 in FIGS. 1 to 9. The bulb socket 1 is comprised of a substantially L-shaped socket main body 2 that is formed unitarily from a synthetic resin. The bulb socket 1 also has two terminals 3 accommodated into the socket main body 2. The socket main portion 2 has a bulb accommodating portion 21 and a connector accommodating portion 25 that have openings extending substantially normal to each other. The bulb accommodating portion 21 opens up in FIG. 1, and the connector accommodating portion 25 opens leftward in FIG. 1. A bulb B is fittable into the opening of the bulb accommodating portion 21 along a bulb-inserting direction, whereas a power-supply side connector (not shown) is fittable into the opening of the connector accommodating portion 25 along a connector inserting direction. Although not shown in detail, the bulb B of this embodiment is of the wedge base type.

Each terminal 3 is made of an electrically conductive metal and includes a power-supplying tab 31 and a bulb connecting portion 32. The power-supplying tab 31 is in the form of a plate that has a base end and a free end. The free end is cantilevered from the base end along an inserting direction of the terminal 3 and projects the opening of the connector accommodating portion 25. Thus, the free end of the power-supplying tab 31 is connectable with the power-supply side connector.

The bulb connecting portion 32 is at the end of the terminal 3 opposite the power-supplying tab 31. The bulb connecting portion 32 includes a side plate 33 and two bent portions 34A and 34B that extend from the opposite left and right ends of the side plate 33.

The bent portions 34A and 34B are strip-shaped. Lateral edges of upper parts of the bent portions 34A are coupled to the opposite ends of the side plate 33 and are bent at right angles to the side plate 33 so as to face each other. On the other hand, bulb contact pieces 35A and 35B extend down from lower parts of the bent portions 34A and 34B and can be brought into contact with the bulb B. The bulb contact pieces 35A and 35B are turned inward at positions slightly below their coupling to the side plate 33 and then are turned moderately at positions near the upper edge of the side plate portion 33 to extend away from each other. Thus, the ends of the bulb contact pieces 35A and 35B face in opposite directions (along transverse direction in FIG. 1). The bulb contact pieces 35A and 35B are resiliently deformable in directions towards and away from each other, so that they can be brought resiliently into contact with the bulb B.

The upper end of the first bent portion 34A is turned out from the side plate 33 and is coupled to the power-supplying tab 31. The second bent portion 34B has a bulb contact piece 35B with an angled contact 36 slightly below the upper end. The contact 36 projects toward the opposite bulb contact piece 35A.

The bulb accommodating portion 21 of the socket main body 2 has a substantially tubular bulb-receiving wall 22 and a substantially tubular terminal accommodating wall 23 below the bulb-receiving wall 22. Two terminal mounting portions 24 are formed inside the tubular terminal accommodating wall 23 at facing positions near the top and bottom in FIG. 1, and the center of the tubular terminal accommodating wall 23 is between the terminal mounting portions 24. The bulb connecting portions 32 of the terminals 3 can be accommodated in the terminal mounting portions 24.

The connector accommodating portion 25 is a tube of substantially elliptic cross section and extends substantially normal to the bulb accommodating portion 21 at one side of the terminal accommodating wall 23. An introducing channel 26 extends between the connector accommodating portion 25 and the terminal accommodating wall 23 of the bulb accommodating portion 21 and provides communication therebetween. Thus, the bulb accommodating portion 21 and the connector accommodating portion 25 communicate with each other at their back sides in directions substantially normal to each other.

The introducing channel 26 has a wide rectangular cross section that is slightly smaller than the opening of the connector accommodating portion 25. Additionally, the height of the introducing channel 26 along the bulb-inserting direction is less than the maximum height of the bulb connecting portions 32 of the terminals 3. Thus, the bulb connecting portions 32 of the terminals 3 can pass through the introducing channel 26. A locking hole 27 is formed in the ceiling wall of the introducing portion 26.

A retainer 37 is mounted into the introducing portion 26 for retaining the terminals 3. The retainer 37 is a block that is just fittable into the introducing channel 26. Left and right tab holes 38 penetrate the retainer 37 at positions slightly above a vertical middle position of the retainer 37 in an inserting direction of the retainer 37 into the introducing channel 26. Further, an engaging projection 39 is provided on the upper surface of the retainer 37. The terminals 3 are retained by engagement of the engaging projection 39 with the locking hole 27 of the introducing channel 26.

The power-supplying tabs 31 of the terminals 3 are pushed into the tab holes 38 in the inserting direction of the retainer 37 from front so that the side plates 33 of the bulb connecting portions 32 oppose each other. As a result, the terminals 3 are fixed in the retainer 37 so that the bulb connecting portions 32 project from the front wall of the retainer 37 with respect to the inserting direction and the power-supplying tabs 31 project from the rear surface of the retainer 37.

The subassembly of the terminals 3 and the retainer 37 is inserted into the connector accommodating portion 25 of the socket main body 2. Thus, the bulb connecting portions 32 pass through the introducing channel 26 and then the retainer 37 enters the introducing channel 26. Assembling the terminals 3 with the retainer 37 enables the terminals 3 to be inserted smoothly without the power-supplying tab portions 31 of the terminals 3 shaking in the introducing channel 26.

The engaging projection 39 of the retainer 37 engages the locking hole 27 of the introducing channel 26 to lock the retainer 37 at a specified position in the introducing channel 26 when the bulb connecting portions 32 of the terminals 3 reach the terminal accommodating portion 23. At this time, the power-supplying tabs 31 of the terminals 3 project into the connector accommodating portion 25. The bulb B then can be fit into the bulb accommodating portion 21 and the power-supply side connector can be fit into the connector accommodating portion 25.

As described above, each terminal 3 of the bulb socket 1 has the power-supplying tab 31 and the bulb connecting portion 32 that are unitary with one another. Additionally, the bulb connecting portion 32 is on an extension of the power-supplying tab 31 that extends along the inserting direction into the connector accommodating portion 25. The bulb connecting portion 32 does not project up normal to the extension of the power-supplying tab 31. Thus, the height of the bulb socket 1 is reduced. Further, the height of the bulb socket 1 is reduced as compared to a case where bulb terminals and connector terminals are separate, since it is unnecessary to provide couplings for the terminals. Further, the number of assembling steps is reduced since a step of assembling both terminals is not necessary, and deformation of the terminals due to wrenching during the assembling can be avoided. Furthermore, a reduction in the number of parts can lead to reduced production cost.

The connector accommodating portion 25 is provided with the introducing channel 26 for introducing the bulb connecting portion 32 from the connector accommodating portion 25 to the accommodating positions for the bulb connecting portions 32. Additionally, the terminals 3 can be mounted from the side of the connector accommodating portion 25. With such a construction, it is not necessary to provide a separate opening for inserting the terminals. Thus, the bulb socket 1 can be made watertight.

The retainer 37 for retaining the terminals 3 is assembled with the power-supplying tabs 31 and is accommodated in the introducing portion 26. This construction prevents the power-supplying tabs 31 from shaking in the introducing portion 26 during the insertion of the terminals 3 into the bulb socket 1. Therefore, the terminals 3 can be inserted smoothly.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Each terminal 3 is an integral assembly of the power-supplying tab 31 and the bulb connecting portion 32 in the foregoing embodiment. However, the bulb terminal and the connector terminal may be provided separately.

The bulb socket 1 used to mount the bulb B of the wedge base type is shown in the foregoing embodiment. However, the invention is applicable to a bulb socket of any type as long as openings that serve as a bulb accommodating portion and a connector accommodating portion extend substantially normal to each other. For example, the invention may be applied to a bulb socket for a base bulb.

What is claimed is:

1. A bulb socket, comprising:

a socket main body with a bulb accommodating portion having openings aligned for receiving a bulb along a bulb receiving direction, a substantially tubular connector accommodating portion extending in an inserting direction substantially normal to the bulb receiving direction, and an introducing channel extending along the inserting direction and providing communication between the connector accommodating portion and the bulb accommodating portion, the introducing channel having a height along the bulb receiving direction; and two terminals disposed in the socket main body, each of the terminals having a power-supplying tab aligned along the inserting direction, each of the power-supplying tabs having a base end in the introducing channel and a free end projecting into the connector accommodating portion, each of the terminals further having a bulb connecting portion unitary with the power-supplying tab and extending from the base end of the power-supplying tab into the bulb-accommodating portion, the bulb connecting portion having a height along the bulb receiving direction that is no greater than the height of the introducing channel, whereby the bulb connecting portion can be inserted along the inserting direction through the introducing channel and into the bulb accommodating portion.

2. The bulb socket of claim 1, further comprising a retainer for retaining the terminal, the retainer being assembled with the power-supplying tab and being accommodated in the introducing channel.

3. The bulb socket of claim 2, wherein the retainer and the introducing channel have interengaged locking structures for locking the retainer in the introducing channel.

4. The bulb socket of claim 3, wherein the bulb connecting portion of each of said terminals includes a first contact support bent from the base end of the power-supplying tab and aligned substantially normal to the power-supplying tab, a side plate bent from one edge of the first contact support so that the side plate is substantially normal to both the first contact support and the power-supplying tab, a second contact support bent from an end of the side plate opposite the first contact support and aligned substantially normal to the side plate, first and second bulb contact pieces bent respectively from the first and second contact supports and having facing convex contact surfaces for engaging the bulb.

5. A terminal for a bulb socket, the terminal being formed from a unitary piece of conductive metal and comprising: a substantially plate-shaped power-supplying tab having a base end and a free end, a first contact support bent from the base end of the power-supplying tab and aligned substantially normal to the power-supplying tab, a side plate bent from one edge of the first contact support so that the side plate is substantially normal to both the first contact support and the power-supplying tab, a second contact support bent from an end of the side plate opposite the first contact support and aligned substantially normal to the side plate, first and second bulb contact pieces bent respectively from the first and second contact supports and having facing convex contact surfaces for engaging a bulb, wherein the power supplying tab defines a plane, an extension of the plane of the power-supplying tab intersects the side plate and the bulb contact pieces.

* * * * *